US010064466B2

(12) United States Patent
Fulton et al.

(10) Patent No.: US 10,064,466 B2
(45) Date of Patent: Sep. 4, 2018

(54) REMOVABLE STORAGE BOX COVER

(71) Applicants: Dean Christopher Fulton, Parkland, FL (US); Valerie Lois Fulton, Parkland, FL (US)

(72) Inventors: Dean Christopher Fulton, Parkland, FL (US); Valerie Lois Fulton, Parkland, FL (US)

(73) Assignee: Protect A Box LLC, DE (US)

( * ) Notice: Subject to any disclaimer, the term of this patent is extended or adjusted under 35 U.S.C. 154(b) by 0 days.

(21) Appl. No.: 15/004,741

(22) Filed: Jan. 22, 2016

(65) Prior Publication Data

US 2017/0210512 A1 Jul. 27, 2017

(51) Int. Cl.

| | |
|---|---|
| ***B65D 30/00*** | (2006.01) |
| ***A45C 7/00*** | (2006.01) |
| ***A45C 13/00*** | (2006.01) |
| ***A45C 13/10*** | (2006.01) |

(52) U.S. Cl.

CPC ..... *A45C 7/0077* (2013.01); *A45C 13/002* (2013.01); *A45C 13/1023* (2013.01); *H05K 999/99* (2013.01)

(58) Field of Classification Search

CPC ..... B65D 81/3886; B65D 25/34; B65D 33/2591; B65D 77/0406; A61G 5/10; B62D 1/06; E04G 21/30

USPC ..... 150/154–168; 190/107, 18 A, 26; 206/223, 289, 320, 541, 576, 597, 600; 220/1.6, 694; D3/274, 279, 318; D14/449

See application file for complete search history.

(56) References Cited

U.S. PATENT DOCUMENTS

| | | | | |
|---|---|---|---|---|
| 3,314,464 | A | 4/1967 | Veilleux et al. | |
| 3,901,360 | A | 8/1975 | Cook | |
| 3,998,304 | A | 12/1976 | Edgerton, Jr. et al. | |
| 4,099,656 | A * | 7/1978 | Neumann | A45C 3/00 294/157 |
| 4,421,150 | A | 12/1983 | Masters | |
| 5,083,644 | A | 1/1992 | Collins, III | |
| 5,172,795 | A | 12/1992 | Riceman | |

(Continued)

OTHER PUBLICATIONS

Ziploc Flexible Totes Xxl (Pack of 5), http://www.walmart.com/ip/Ziploc-Flexible-Totes-Xxl-Pack-of-5/34957395 (Nov. 16, 2015).

*Primary Examiner* — Fenn C Mathew
*Assistant Examiner* — Cynthia Collado
(74) *Attorney, Agent, or Firm* — Mark C. Johnson; Johnson | Dalal

(57) ABSTRACT

A removable storage box cover having a bottom wall having a fore edge, at least two sidewalls having upper edges, fore edges, and defining a rectangular internal cavity, and a lid hingedly coupled to one of the at least two sidewalls, wherein the lid includes an upper wall portion having lateral side edges and a sidewall portion having lateral side edges and a lower edge separating the lateral side edges of the sidewall portion of the lid. The cover also includes a first track spanning the perimeter of the exposed edges of the at least two side walls and bottom wall and a second track spanning the perimeter of the exposed edges of the lid, wherein the lid, sidewalls and bottom wall are operable to be joined together in a watertight relationship with one another to enclose a box and be opened to insert or remove a box.

18 Claims, 6 Drawing Sheets

(56) References Cited

U.S. PATENT DOCUMENTS 5,293,975 A 3/1994 Howorka
5,423,404 A * 6/1995 Shaw ..... A45C 3/00 190/102
5,575,362 A * 11/1996 Franklin ..... A45C 3/004 16/113.1
5,575,382 A * 11/1996 Sobel ..... A61B 17/06123 206/380
5,782,360 A * 7/1998 Markson ..... B65D 19/385 150/154
6,279,796 B1 8/2001 Trevino
6,328,158 B1 * 12/2001 Bisbal ..... A45C 3/00 206/223
7,093,699 B2 8/2006 Yu
7,102,516 B2 9/2006 Orman
7,270,237 B2 9/2007 Mandeltort
7,441,641 B2 10/2008 Beakey
7,458,452 B2 12/2008 Beakey
7,861,857 B2 * 1/2011 Vorderkunz ..... A45C 13/03 190/115
8,225,934 B1 * 7/2012 Malcolm ..... A45C 7/0095 190/1
8,295,896 B2 10/2012 Jeon
9,004,119 B2 4/2015 Piper
2003/0010780 A1 * 1/2003 Redzisz ..... A45C 7/0077 220/6
2005/0051247 A1 3/2005 Johnson
2006/0086444 A1 * 4/2006 Yu ..... A45C 13/002 150/154
2007/0113384 A1 * 5/2007 Ortlieb ..... A44B 19/26 24/385
2009/0057308 A1 * 3/2009 Rothschild ..... A45F 4/06 220/7
2009/0154844 A1 6/2009 Greenberg
2011/0129170 A1 6/2011 Campbell
2014/0217162 A1 8/2014 Chalifoux

* cited by examiner

100

100

100

100

REMOVABLE STORAGE BOX COVER

FIELD OF THE INVENTION

The present invention relates generally to storage box covers, and, more particularly, relates to a storage box cover that is operable to be removably sealed.

BACKGROUND OF THE INVENTION

Storage boxes, particularly banker's boxes, and other similarly shaped boxes for storing documents, files, and other items are well known. While the advent of digital storage mediums has somewhat reduced the dissemination of physical documents, receiving and storing physical documents is still required and sometimes preferred by many individuals. Many individuals store these documents in boxes or containers. Often times, these boxes or containers are specifically shaped and designed to orient and store particular types of documents. Many individuals desire the use of banker's boxes because of their ability to store a sufficient amount of documents, because they have sufficient rigidity to resist compressive forces generated from stacking multiple boxes on top of one another, and because they keep the documents relatively safe from the elements and environment.

Many problems arise when storing documents in boxes or containers, however. As mentioned, the documents are only relatively safe. Many boxes or containers are made from a paper by-product such as cardboard, which make them prone to being damaged by liquids such as water. Additionally, boxes or containers also permit dust mites and insects to enter, which often leads to the documents being damaged or destroyed entirely. Many of those containers and boxes not made of a paper by-product are generally more expensive and also do not limit the housed documents exposure to elements of the environment and insects.

Some attempts have been made to alleviate the above issues, but they too have failed to generate an effective, efficient, and low-cost solution to protect boxes and containers used to store documents, household items, or other similar articles. For example, one apparatus includes covering a paper box with a plastic garbage bag having a drawstring used to enclose the box. Again, this does not completely shield the box from the elements or insects, nor does it provide a user easy access to the documents when desired because it does not have any rigidity. Another example can be seen described in U.S. Patent Application Publication No. 2011/0129170, entitled "Flood proof container." This apparatus is a flexible bag having an upper opening for receiving contents, wherein the device is operable to form a watertight seal in order to prevent access from fluids such as water. This device, however, is not operable to be re-used and must be disposed of after the watertight seal is broken. Moreover, it doesn't provide users access from the front of the container, which is desired by many users.

Another example of an apparatus used to house boxes can be seen described in U.S. Patent Application Publication No. 2009/0154844, entitled "Insect protecting cover and insect shielded bag and container." This apparatus was designed for housing and storing luggage by the user. This apparatus is a rectangular-shaped cover defining an internal cavity and having a top removably sealed through use of a zipper. First, this apparatus does not enable users to have quick and effective access to the internal cavity through the front of the apparatus; rather, it is limited only to providing user access from the top. In fact, because it is designed specifically for luggage, the apparatus provides for other smaller access areas, i.e., for handles and wheels of the luggage, in the front where access to boxes, such as banker's boxes, is desired. This apparatus also does not enable users the ability to effectively fold and store away the apparatus when not in use. Further, this apparatus does not disclose it having a watertight seal; rather, it only discloses having a bag arranged to "substantially prevent bugs, such as bed bugs, from accessing its interior." Also, due to the cloth zipper use, the apparatus cannot be watertight.

Therefore, a need exists to overcome the problems with the prior art as discussed above.

SUMMARY OF THE INVENTION

The invention provides a removable storage box cover that overcomes the hereinafore-mentioned disadvantages of the heretofore-known devices and methods of this general type and that provides a safe and secure environment for the documents housed therein while simultaneously providing users quick and effective access to the internal cavity defined by the cover.

With the foregoing and other objects in view, there is provided, in accordance with the invention, a removable storage box cover having a bottom wall having a fore edge, at least two sidewalls having upper edges, fore edges, and defining, with the bottom wall, an internal cavity—which may be rectangular, and a lid hingedly coupled to one of the at least two sidewalls. The lid includes an upper wall portion having lateral side edges and a sidewall portion having lateral side edges and a lower edge separating the lateral side edges of the sidewall portion of the lid. The invention also includes a zipper assembly used to seal the cover and enclose the box housed therein. The zipper assembly may have a first track spanning continuously along the upper and fore edges of the at least two sidewalls and the fore edge of the bottom wall, a second track spanning continuously along the lateral side edges of the upper wall portion of the lid and the lateral side edges and lower edge of the sidewall portion of the lid, and at least one locking member disposed on at least one of the first and second tracks. The cover includes a closed position with the bottom wall, at least two sidewalls, and lid selectively coupled together, through the at least one locking member, in a watertight relationship along the first and second tracks of the zipper assembly. The closed position also disposes the upper wall portion of the lid at a substantially perpendicular configuration with respect to the sidewall portion of the lid so as form sidewalls enclosing the box housed therein. The box also includes an open position with the lid removed from the bottom wall and the at least two sidewalls to expose the internal cavity for insertion or removal of a box.

In accordance with another feature, an embodiment of the present invention includes the open position having a first entrance aperture into the rectangular internal cavity defined by the upper edges of the at least two sidewalls and a second entrance aperture into the rectangular internal cavity defined by the fore edges of the at least two sidewalls and the fore edge of the bottom wall. The first and second entrance apertures may be disposed in substantially perpendicular orientations with one another, i.e., to have access to the cavity from the front and top of the cover.

In accordance with a further feature of the present invention, the upper wall and sidewall portions of the lid are shaped to correspond with the first and second entrance apertures and the open position includes the at least two sidewalls independently maintaining an upright orientation with respect to the bottom wall.

In accordance with an additional feature of the present invention, the at least two sidewalls are of a substantially rigid polymeric material.

In accordance with yet another feature of the present invention, the upper wall and sidewall portions of the lid are predisposed in a substantially perpendicular configuration.

In accordance with a further feature of the present invention, the first and second tracks are disposed at the respective terminal edges of the bottom wall, the at least two sidewalls, and the upper wall and sidewall portions of the lid. Said another way, the tracks may span the entire perimeter of the exposed edges of the lid and sidewalls and bottom wall.

In accordance with another feature, an embodiment of the present invention also includes a collapsed position having the bottom wall, the at least two sidewalls, and the upper wall and sidewall portions of the lid all disposed in an overlapping, substantially parallel, configuration with one another.

In accordance with the present invention, a removal strorage box cover is also disclosed that includes a housing with a bottom wall having a fore edge, at least two sidewalls extending upwardly from the bottom wall and having upper edges, fore edges, and defining, with the bottom wall, an internal cavity, and a lid rotatably coupled to one of the at least two sidewalls at a hinge joint and including an upper wall portion having lateral side edges and a sidewall portion having lateral side edges and a lower edge separating the lateral side edges of the sidewall portion of the lid. The lid may be selectively removably couplable, through a zipper assembly, to the at least two sidewalls and the bottom wall to form a watertight joint that continuously spans from the hinge joint along the upper and fore edges of the at least two sidewalls and the fore edge of the bottom wall.

In accordance with the present invention, a removal strorage box cover is also disclosed that includes a bottom wall having a fore edge, at least two sidewalls upright to the bottom wall and having upper edges, fore edges substantially perpendicular to the fore edges, and defining, with the bottom wall, an internal cavity, and a lid hingedly coupled to one of the at least two sidewalls, the lid including an upper wall portion and a sidewall portion both having perimeter edges defining a lid perimeter. The cover includes a zipper assembly having a first track spanning continuously along the upper and fore edges of the at least two sidewalls and the fore edge of the bottom wall, a second track spanning continuously along the lid perimeter, and at least one locking member disposed on at least one of the first and second tracks. The cover also includes a closed position where the bottom wall, at least two sidewalls, and lid are selectively coupled together, through the at least one locking member, in a watertight relationship along the first and second tracks of the zipper assembly, and an open position with the lid removed to expose the internal cavity for insertion or removal of a storage box.

Although the invention is illustrated and described herein as embodied in a box, it is, nevertheless, not intended to be limited to the details shown because various modifications and structural changes may be made therein without departing from the spirit of the invention and within the scope and range of equivalents of the claims. For example, the present invention may be utilized with other storage boxes and containers, e.g., a banker's box. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the rear side of the cover to the front side of the cover.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
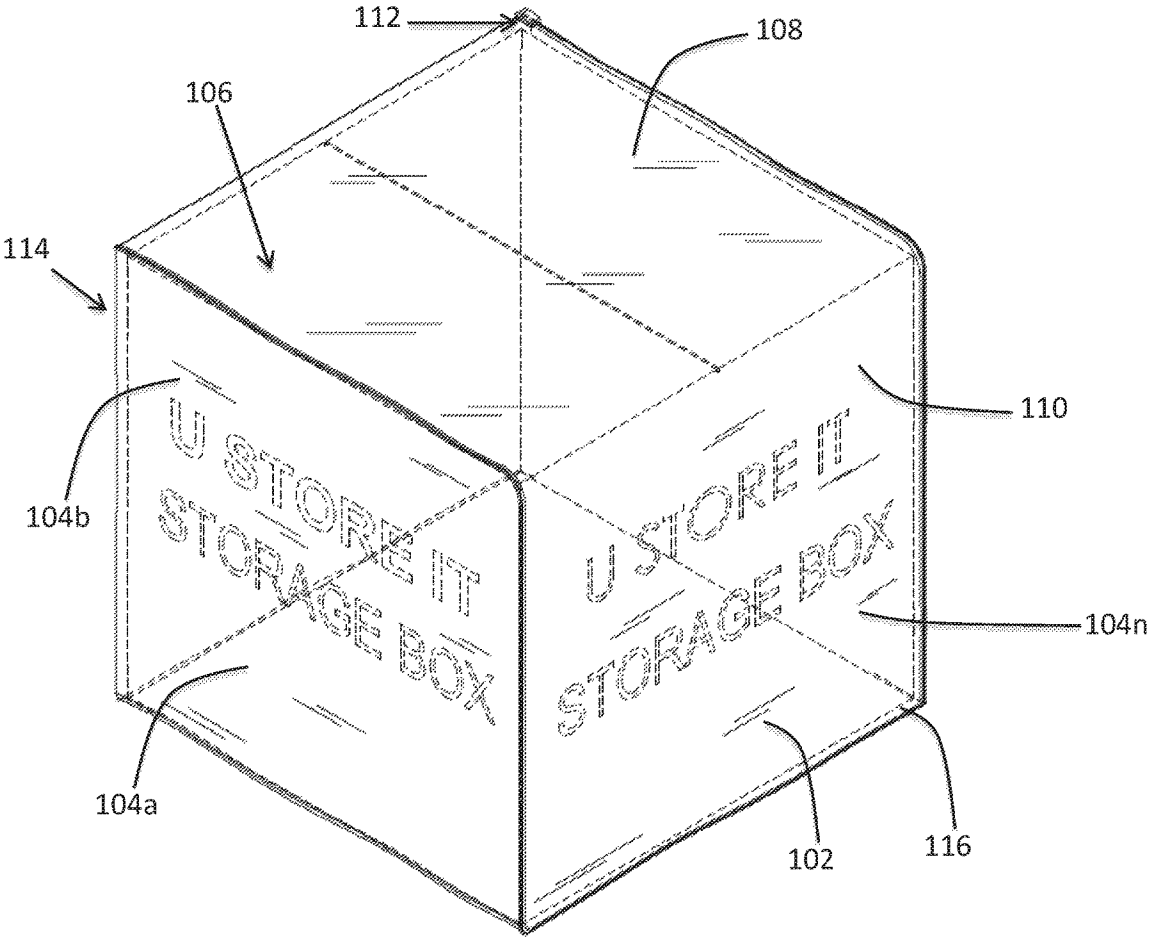
FIG. 1 is a perspective downward-looking view of a removable box cover in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient box cover that enables users quick and easy access to the internal cavity of the cover, in addition to providing a safe environment for the documents housed within the box and cover.

Figure 3:
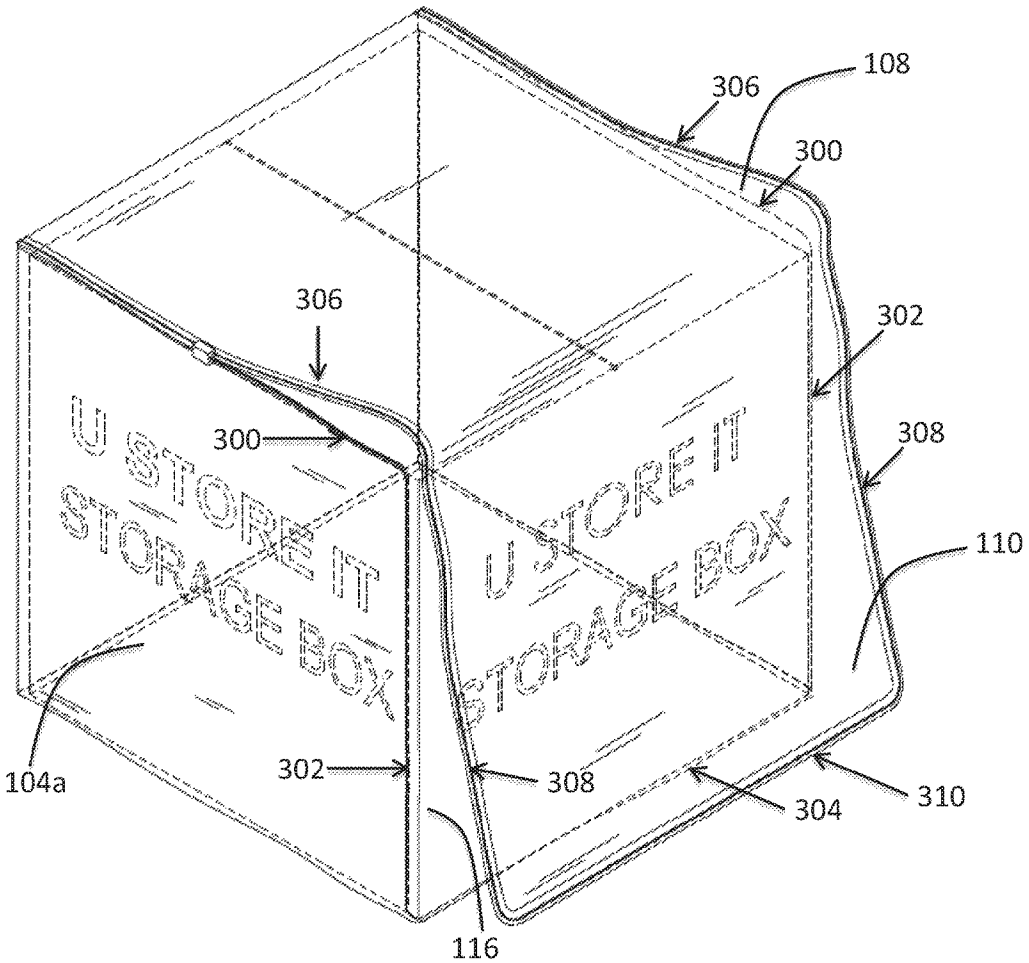
FIG. 3 is a perspective downward-looking view of the box cover of FIG. 1 with the lid at least partially in an open position.
Figure 4:
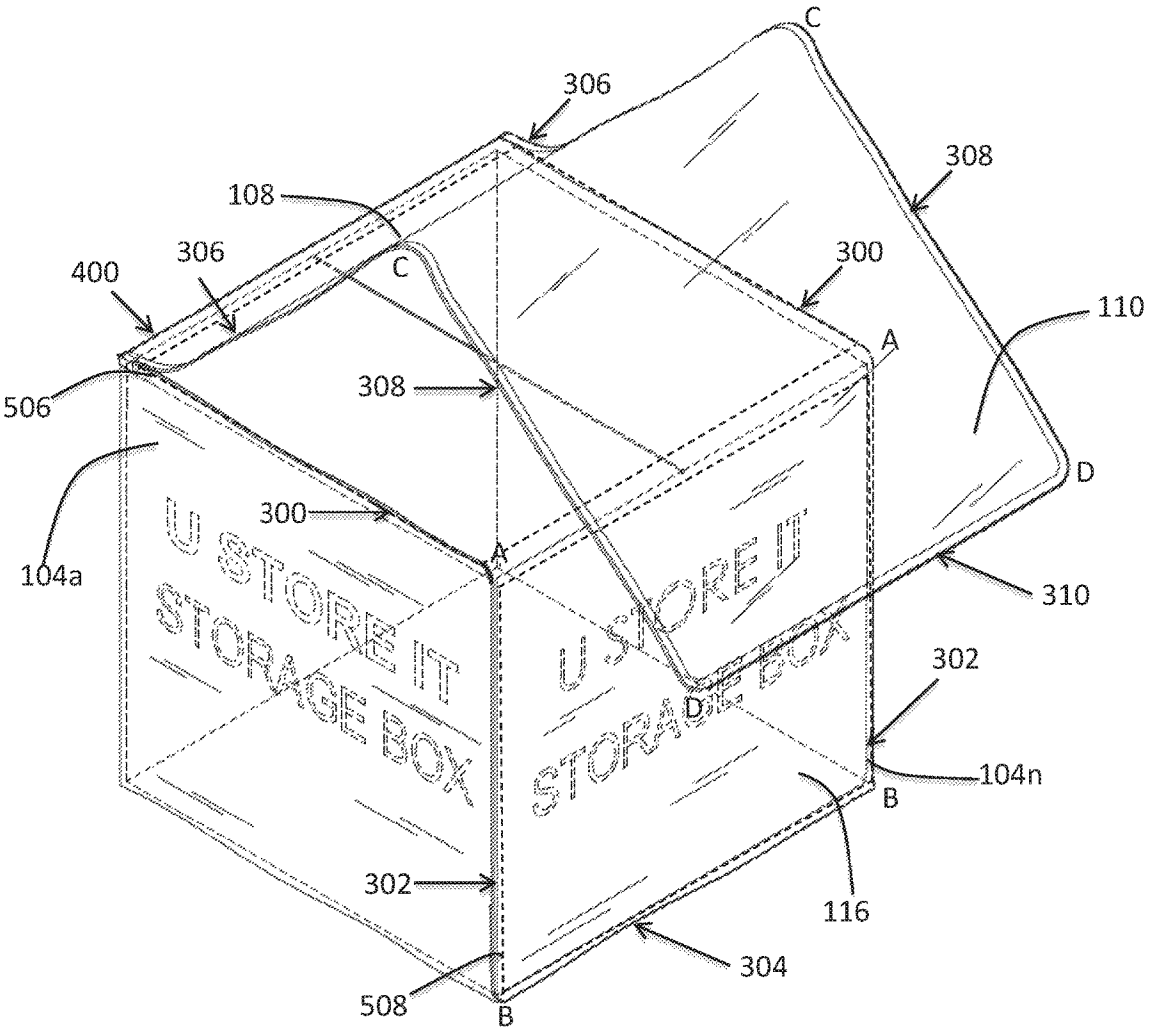
FIG. 4 is a perspective downward-looking view of the box cover of FIG. 1 with the lid in an open position.

Referring now to FIG. 1, one embodiment of the present invention is shown in a perspective downward-looking view. FIG. 1 shows several advantageous features of the present invention, but, as will be described below, the invention can be provided in several shapes, sizes, combinations of features and components, and varying numbers and functions of the components. The first example of a removable box cover 100, as shown in FIG. 1, includes a bottom wall 102, at least two sidewalls 104*a-n*, and a lid 106 having an upper wall portion 108 and a sidewall portion 110, wherein "n" represents any number greater than one. While the cover 100 is shown in a rectangular shape with dimensions of approximately of 24½'×12½'×11' (length×width×height), it will be appreciated by those of skill in the art that the cover 100 could be of a triangular shape or another oblong shape with various dimensions to house a box or container similar to that of a banker's box in accordance with the disclosure herein. FIG. 1 also depicts the cover 100 in a closed position, or when the lid 106 is coupled to the sidewalls 104*a-n* and bottom wall 102 in a watertight relationship or configuration. The term "watertight" is defined as having a construction or fit so as to be impermeable to water (at 1 bar) except when under sufficient pressure to produce structural discontinuity or plastic deformation. FIGS. 1 and 3-4 also depict an exemplary box 116 housed by the cover 100.

Figure 2:
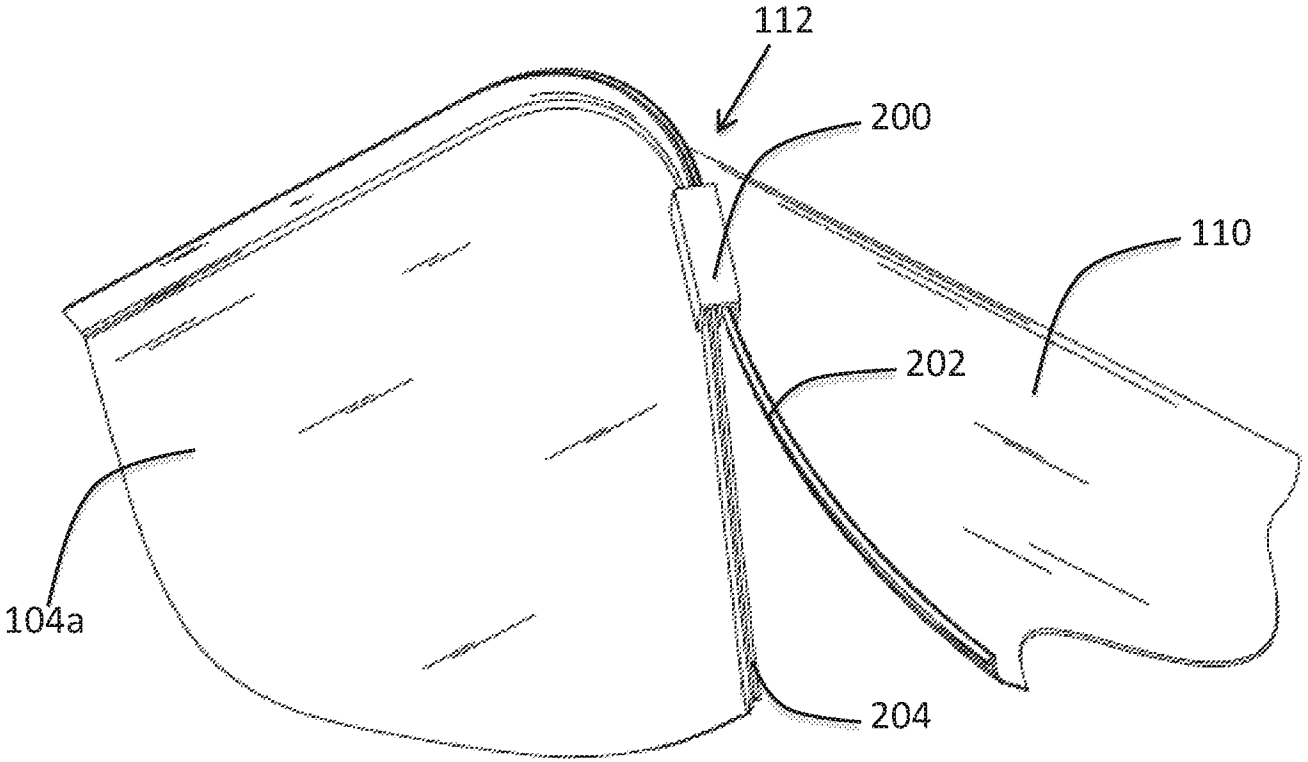
FIG. 2 is a close-up view of an exemplary zipper assembly utilized by the box cover apparatus of FIG. 1 in accordance with the present invention.

Advantageously, and with reference to both FIGS. 1 and 2, the cover 100 can be seen having a zipper assembly 112 that enables a user to open the lid 106 so as to insert or remove a container or box and then close the lid 106 in a watertight configuration to enclose the box or container in a safe and effective manner. The term "watertight" is defined as The operation and configuration of the lid 106 with respect to the sidewalls 104*a-n* and bottom wall 102 also enables the user to access an internal cavity 500 (shown best in FIG. 5) defined by the cover 100, or also referred to as a "housing" 114. The zipper assembly 112 may consist of one or more locking members 200, e.g., a zipper handle, disposed on a first track 202 or a second track 204, e.g., a plurality of teeth or a tongue-and-grove configuration. The zipper assembly 112, however, may take the form of any configuration of structures or devices which can removably seal the lid 106 with the walls 104*a-n*, 102.

The closed position of the cover 100 may be described as having the bottom wall 102, the sidewalls 104*a-n*, and the lid 106 selectively coupled together by the user, through the at least one locking member 200, in a watertight relationship along the first and second tracks 202, 204. The closed position of the cover 100 may also result in disposing the upper wall portion 108 of the lid 106 at a substantially perpendicular (90°+/−10° configuration with respect to the sidewall portion 110 of the lid 106 so as to contour any box 116 housed therein and minimize the space taken up by the cover 100. As such, it is envisioned that the present invention will be sold in various shapes and sizes to enclose and/or contour boxes or containers of various sizes and shapes.

Figure 5:
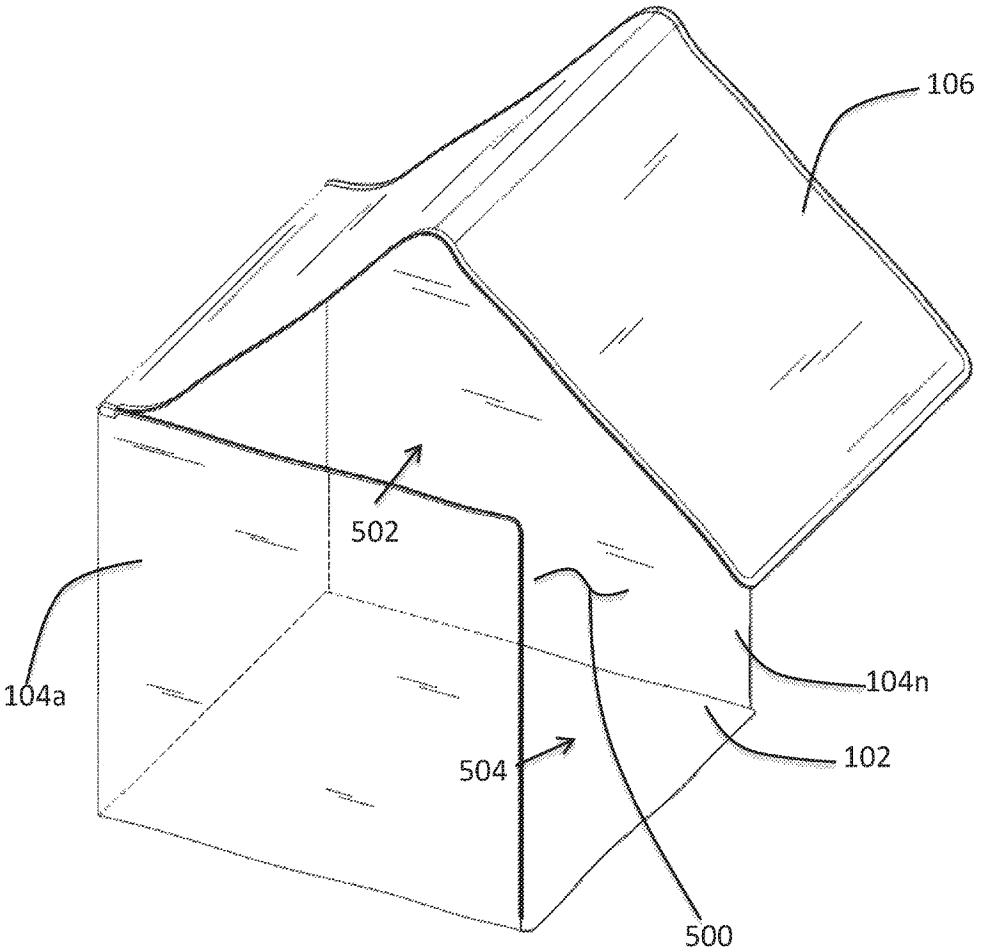
FIG. 5 is a perspective downward-looking view of the box cover of FIG. 1 with the lid in an open position.

With reference now to FIGS. 2-5, the first track 202 may span continuously along an upper edge 300 and fore edge 302 of each of the sidewalls 104*a-n* and a fore edge 304 of the bottom wall 102. The second track 204 spans continuously along the lateral side edges 306 of the upper wall portion 108 of the lid 106 and the lateral side edges 308 and lower edge 310 of the sidewall portion 110 of the lid 106. The tracks 202, 204 can be seen spanning substantially from the joint 400, i.e., within approximately 0.25", where the lid 106 is hingedly coupled or rotatably coupled to one or more of the sidewalls 104*a-n* so as to inhibit the entry of fluids within the cavity 500. FIGS. 3-5 also illustrate an exemplary translation of the lid 106 with respect to the sidewalls 104*a-n* to effectuate quick and effective entry and removal of any box or contents when the cover 100 is in the open position. The open position includes the lid removed or detached from the bottom wall 102 and the at least two sidewalls 104*a-n* to expose the internal cavity 500, which may be rectangular or another shape defined by the inner surfaces of the sidewalls 104*a-n* and bottom wall 102, for insertion or removal of a box, e.g., a banker's box.

With reference specifically to FIG. 4, the edges 300, 302 can be seen disposed at the terminal ends, or exposed ends, of the opposing sidewalls 104*a*, 104*n* and intersect at respective corners labeled as "A". Similarly edges 302, 304 intersect at respective corners "B", edges 306, 308 intersect at respective corners "C", and edges 308, 310 intersect at respective corners "D". The corners A, B, C, D are preferably chamfered or rounded to accommodate the zipper 200 and tracks 202, 204 as the lid 106 is coupled to the sidewalls 104.

Figure 6:
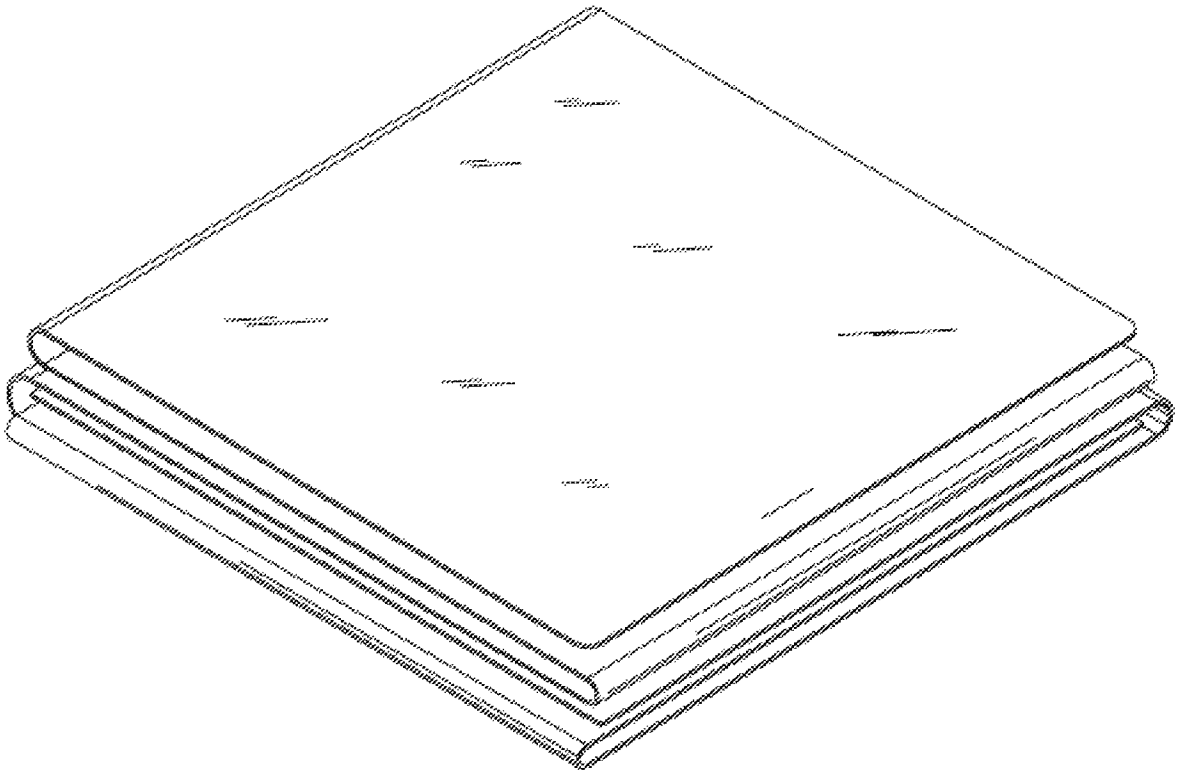
FIG. 6 is a perspective downward-looking view of the box cover of FIG. 1 in a collapsed, folded, position.

When the lid 106 is in the open position, as shown in FIGS. 5-6, a first entrance aperture 502 into the internal cavity 500 can be seen defined by the upper edges 300 of the at least two sidewalls 104*a-n*. A second entrance aperture 504 into the internal cavity 500 can also be defined by the fore edges 302 of the at least two sidewalls 104*a-n* and the fore edge 304 of the bottom wall 102. The first and second entrance apertures 502, 504 are disposed in a substantially perpendicular orientation with one another. Said another way, the flanking upper edges 300 of the sidewalls 104*a-n* define a first plane 506, while the flanking fore edges 302 of the sidewall 104*a-n* and the fore edge 304 of the bottom wall 102 define a second plane 508, wherein the planes 506, 508 are substantially perpendicular with one another. As such, the cover 100 advantageously provides users two access and removal points, both above and below, into the internal cavity 500 that is not accomplished with known covers. The upper wall and sidewall portions 108, 110 of the lid 106 can also be seen shaped to correspond with the first and second entrance apertures 502 to ensure alignment of the tracks 202, 204 and a watertight seal that protects the box housed therein.

The cover 100 is illustrated with three sidewalls 104*a-n* forming a rectangular shape, wherein only two of the three sidewalls 104*a-n* have the edges 300, 302 describe above to ensure the box or container housed therein is enclosed when the lid 106 is in the closed position. Beneficially, when the cover 100 is in the open position, the at least two sidewalls

104*a-n* are operable to be independently maintained in an upright orientation with respect to the bottom wall 102. Said another way, they are operable to stay upright without support or bracing from other structures. The sidewalls 104*a-n* are able to maintain that position principally because the at least two sidewalls 104*a-n* may be made using a substantially rigid polymeric material that still has some flexibility, such as plasticized PVC (polyvinyl chloride), polypropylene, or high density polyethylene. Other similar materials will be appreciated by those of skill in the art. The sidewalls 104*a-n* may also be made with other materials, such composites. The sidewalls 104*a-n* may also utilize metallic supports or other rigid materials encapsulated within the wall for structural stability.

The thickness of the walls 102, 104*a-n*, 108, 110 may be approximately 0.25" to 1" depending on the design constraints. The material used to form the cover 100 may be transparent in one embodiment to adequately view the contents within the cover 100. In other embodiments, the material may be translucent or opaque.

In one embodiment, the upper wall and sidewall portions 108, 110 of the lid 106 are predisposed in a substantially perpendicular configuration to ensure sufficient enclosure and/or contouring of the box or container housed therein. This predisposition may occur, for example, through a manufacturing process such as stamping. In other embodiments, the lid 106 is unbiased to any particular orientation or configuration and will be able to free-form so as to conform with a variety of shapes or contours.

With reference now to FIG. 6, a collapsed position of the cover 100 can be seen with the bottom wall 102, the at least two sidewalls 104*a-n*, and the upper wall and sidewall portions 108, 110 of the lid 106 all disposed in an overlapping, substantially parallel, configuration with one another. As such, the configuration of the walls 102, 104*a-n*, 106 enable the cover 100 to be beneficially collapsed into a relatively planar configuration that is conducive for storing and transporting when not in use. When collapsed, the cover 100 may employ the use of snaps, Velcro or other fasteners to retain the overlapping configuration.

When desired for use, the user simply unfolds the cover 100 such that is configured as depicted in FIGS. 1-5. Specifically, the user places the cover 100 in the configuration shown in FIG. 5, for example, and inserts a box or container. Because the cover 100 exposes the two apertures 502, 504, or "openings," the user is able to effectively and efficiently insert the box without structural deformation of cover 100. The user then selectively couples the lid 106 to the sidewalls 104*a-n* by zipping or fastening the two tracks 202, 204 together in a watertight relationship. Said another way, one or more zipper members 200 are navigated around the perimeter of the lid 106, sidewalls 104*a-n*, and bottom wall 102 to form a watertight joint that continuously spans along the upper and fore edges 300, 302 of the at least two sidewalls 104*a-n* and the fore edge 304 of the bottom wall 102. Therefore, because the walls 102, 104*a-n*, 106 may be completely enclosed, the only possibility of entry of fluid into the cavity 500 may arise through the nominal space between the tracks 202, 204 and the joint 400 where the lid 106 is attached to the sidewalls 104*a-n*.

A removably box cover has been disclosed that provides a safe and secure environment for the documents housed therein, while simultaneously providing users quick and effective access to the internal cavity defined by the cover.

What is claimed is:

1. A removable storage box cover comprising:

a bottom wall having a fore edge, at least three sidewalls each completely enclosed and having upper edges, fore edges, and defining, with the bottom wall, a rectangular internal cavity, and a lid with a first end directly hingedly coupled to the upper edge of at least one of the at least three sidewalls, the lid including an upper wall portion that is completely enclosed and having lateral side edges and a sidewall portion that is completely enclosed and having lateral side edges and a second end, opposing the first end of the lid, having a lower edge separating the lateral side edges of the sidewall portion of the lid, at least two of the at least three sidewalls permanently directly coupled to one another along their respective sides in a watertight configuration that spans from the bottom wall to the upper edges of the at least two sidewalls, the bottom wall, the at least three sidewalls, and the upper wall portion and sidewall portion of the lid not having a handle directly coupled thereto;

a zipper assembly having:

a first track beginning substantially from a joint location where the first end of lid is directly hingedly coupled to the upper edge of the at least one of the at least three sidewalls and spanning continuously along the upper and fore edges of the at least two sidewalls and the fore edge of the bottom wall;

a second track beginning substantially from the joint location and spanning continuously along the lateral side edges of the upper wall portion of the lid and the lateral side edges and lower edge of the sidewall portion of the lid; and at least one locking member disposed on at least one of the first and second tracks;

a closed position with the bottom wall, at least two of the at least three sidewalls, and lid selectively coupled together, through the at least one locking member, in a watertight relationship along the first and second tracks of the zipper assembly, the closed position also disposing the upper wall portion of the lid at a substantially perpendicular configuration with respect to the sidewall portion of the lid; and an open position with the lid removed from the bottom wall and the at least two sidewalls to expose the rectangular internal cavity for insertion or removal of a storage box.

2. The removable storage box cover according to claim 1, wherein the open position further comprises:

a first entrance aperture into the rectangular internal cavity defined by the upper edges of the at least three sidewalls and a second entrance aperture into the rectangular internal cavity defined by the fore edges of the at least two of the least three sidewalls and the fore edge of the bottom wall, the first and second entrance apertures disposed in substantially perpendicular orientations with one another.

3. The removable storage box cover according to claim 2, wherein:

the upper wall and sidewall portions of the lid are shaped to correspond with the first and second entrance apertures.

4. The removable storage box cover according to claim 2, wherein:

the open position includes the at least three sidewalls independently maintaining an upright orientation with respect to the bottom wall.

5. The removable storage box cover according to claim 2, wherein:

the at least three sidewalls are of a substantially rigid polymeric material.

6. The removable storage box cover according to claim 1, wherein:

the upper wall and sidewall portions of the lid are predisposed in a substantially perpendicular configuration.

7. The removable storage box cover according to claim 1, wherein:

the open position includes the at least three sidewalls independently maintaining an upright orientation with respect to the bottom wall.

8. The removable storage box cover according to claim 1, wherein:

the first and second tracks are disposed at the respective terminal edges of the bottom wall, the at least two of the at least three sidewalls, and the upper wall and sidewall portions of the lid.

9. The removable storage box cover according to claim 1, further comprising:

a collapsed position having the bottom wall, the at least three sidewalls, and the upper wall and sidewall portions of the lid all disposed in an overlapping, substantially parallel, configuration with one another.

10. A removable storage box cover comprising:

a housing with a bottom wall having a fore edge, at least three sidewalls each completely enclosed and having upper edges, fore edges, and defining, with the bottom wall, an internal cavity, and a lid with a first end directly and rotatably coupled to the upper edge of at least one of the at least three sidewalls at a hinge joint and including an upper wall portion that is completely enclosed and having lateral side edges and a sidewall portion that is completely enclosed and having lateral side edges and a second end, opposing the first end of the lid, a lower edge separating the lateral side edges of the sidewall portion of the lid, the lid is selectively removably couplable, through a zipper assembly, to at least two of the at least three sidewalls and the bottom wall to form a watertight joint beginning substantially from the hinge joint and continuously spanning along the upper and fore edges of the at least two of the at least three sidewalls and the fore edge of the bottom wall, at least two of the at least three sidewalls permanently directly coupled to one another along their respective sides in a watertight configuration extending upwardly from the bottom wall to the upper edges of the at least two of the least three sidewalls, the bottom wall, the at least three sidewalls, and the upper wall portion and sidewall portion of the lid not having a handle directly coupled thereto.

11. The removable storage box cover according to claim 10, wherein:

the at least three sidewalls are of a substantially rigid polymeric material.

12. The removable storage box cover according to claim 10, wherein:

the upper wall and sidewall portions of the lid are predisposed in a substantially perpendicular configuration.

13. The removable storage box cover according to claim 10, further comprising:

a collapsed position having the bottom wall, the at least three sidewalls, and the upper wall and sidewall portions of the lid all disposed in an overlapping, substantially parallel, configuration with one another.

14. The removable storage box cover according to claim 10, wherein:

the sidewall portion of the lid is in a substantially perpendicular configuration with respect to upper portion of the lid when the lid is selectively coupled to the at least two sidewalls and the bottom wall.

15. A removable storage box cover comprising:

a bottom wall having a fore edge, at least three sidewalls each completely enclosed and upright to the bottom wall and having upper edges, at least two of the at least three sidewalls having fore edges substantially perpendicular to the fore edge of the bottom wall, and the at least three sidewalls defining, with the bottom wall, an internal cavity, the bottom wall, the at least three sidewalls, and the upper wall portion and the sidewall portion of the lid not having a handle directly coupled thereto;

a lid with a first end directly and hingedly coupled to the upper edge of at least one of the at least three sidewalls, the lid including an upper wall portion that is completely enclosed and a sidewall portion that is completely enclosed and with a second end, opposing the first end of lid, both the upper wall portion and the sidewall portion having perimeter edges defining a lid perimeter, at least two of the at least three sidewalls permanently directly coupled to one another along their respective sides in a watertight configuration spanning from the bottom wall to the upper edges of the at least two sidewalls;

a zipper assembly having a first track beginning substantially from a joint location where the first end of lid is directly and hingedly coupled to the upper edge of the at least one of the at least three sidewalls and spanning continuously along the upper and fore edges of the at least two of the at least three sidewalls and the fore edge of the bottom wall, a second track beginning substantially from the joint location and spanning continuously along the lid perimeter, and at least one locking member disposed on at least one of the first and second tracks;

a closed position with the bottom wall, the at least two of the at least three sidewalls, and lid selectively coupled together, through the at least one locking member, in a watertight relationship along the first and second tracks of the zipper assembly; and an open position with the lid removed to expose the internal cavity for insertion or removal of a storage box.

16. The removable storage box cover according to claim 15, wherein:

the bottom wall, the at least three sidewalls, and the upper wall and sidewall portions of the lid form a rectangular shape when in the closed position.

17. The removable storage box cover according to claim 15, wherein the open position further comprises:

a first entrance aperture into the internal cavity defined by the upper edges of the at least two of the at least three sidewalls and a second entrance aperture into the internal cavity defined by the fore edges of the at least two of the at least three sidewalls and the fore edge of the bottom wall, the first and second entrance apertures disposed in substantially perpendicular orientations with one another.

18. The removable box storage cover according to claim 17, wherein:

the upper wall and sidewall portions of the lid are shaped to correspond with the first and second entrance apertures.

* * * * *